US010569991B2

(12) United States Patent
Armistead et al.

(10) Patent No.: US 10,569,991 B2
(45) Date of Patent: Feb. 25, 2020

(54) ELEVATOR CONTROL SYSTEM OVERLAY SYSTEM

(71) Applicant: Otis Elevator Company, Farmington, CT (US)

(72) Inventors: Jason R. Armistead, Avon, CT (US); Daniel S. Williams, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 459 days.

(21) Appl. No.: 15/526,499

(22) PCT Filed: Nov. 12, 2015

(86) PCT No.: PCT/US2015/060268
§ 371 (c)(1),
(2) Date: May 12, 2017

(87) PCT Pub. No.: WO2016/077520
PCT Pub. Date: May 19, 2016

(65) Prior Publication Data

US 2017/0305714 A1 Oct. 26, 2017

Related U.S. Application Data

(60) Provisional application No. 62/079,109, filed on Nov. 13, 2014.

(51) Int. Cl.
*B66B 1/24* (2006.01)
*B66B 1/34* (2006.01)

(52) U.S. Cl.
CPC ..... *B66B 1/3423* (2013.01); *B66B 2201/103* (2013.01); *B66B 2201/233* (2013.01)

(58) Field of Classification Search
USPC ..... 187/247
See application file for complete search history.

(56) References Cited

U.S. PATENT DOCUMENTS 5,714,725 A 2/1998 Thangavelu
5,831,226 A 11/1998 Hattori et al.
(Continued)

FOREIGN PATENT DOCUMENTS

CN 102149622 A 8/2011
CN 102046506 B 7/2013
(Continued)

OTHER PUBLICATIONS

ISR/WO for application PCT/US2015/060268, dated Feb. 15, 2016, 13pgs.
(Continued)

*Primary Examiner* — Christopher Uhlir
(74) *Attorney, Agent, or Firm* — Cantor Colburn LLP

(57) ABSTRACT

A method includes recording a primary destination dispatch request from a primary passenger at a first floor position via a destination dispatch controller 115, identifying a terminal floor, providing a terminal floor call signal to the elevator control system via an overlay controller 110, moving an assigned elevator car in a travel direction of the terminal floor, recording at least one secondary destination dispatch request from a secondary passenger at a respective at least one secondary floor position via the destination dispatch controller, approximating a position of the assigned elevator car, determining a target floor position via the destination dispatch controller, entering a target floor call corresponding to the target floor position at a calculated time to stop the assigned elevator car at the target floor position, cancelling
(Continued)

all pending calls via the elevator control system 102, and entering at least one recorded destination dispatch request to the elevator control system.

15 Claims, 5 Drawing Sheets

(56) References Cited

U.S. PATENT DOCUMENTS

| | | | | |
|---|---|---|---|---|
| 5,952,626 | A | 9/1999 | Zaharia | |
| 6,065,570 | A | 5/2000 | Friedli et al. | |
| 6,202,799 | B1 | 3/2001 | Drop | |
| 6,345,697 | B1 | 2/2002 | Siikonen | |
| 6,382,363 | B1 | 5/2002 | Friedli | |
| 6,394,231 | B1 | 5/2002 | Schuster et al. | |
| 6,394,232 | B1 | 5/2002 | Iwata et al. | |
| 6,425,460 | B2 | 7/2002 | Schuster | |
| 6,793,044 | B2 | 9/2004 | Koehler et al. | |
| 6,892,861 | B2 | 5/2005 | Friedli | |
| 6,935,465 | B2 | 8/2005 | Friedli | |
| 6,991,068 | B2 | 1/2006 | Siikonen et al. | |
| 7,021,429 | B2 | 4/2006 | Hikita | |
| 7,032,716 | B2 | 4/2006 | Meyle et al. | |
| 7,083,027 | B2 | 8/2006 | Siikonen et al. | |
| 7,322,446 | B2 | 1/2008 | Terry et al. | |
| 7,353,915 | B2 | 4/2008 | Zaharia et al. | |
| 7,469,772 | B2 | 12/2008 | Takeuchi | |
| 7,549,517 | B2 | 6/2009 | Stanley et al. | |
| 7,849,974 | B2 | 12/2010 | Stanley et al. | |
| 7,900,750 | B2 * | 3/2011 | Mattsson | B66B 1/2458 187/247 |
| 8,047,334 | B2 | 11/2011 | Christy et al. | |
| 8,091,687 | B2 | 1/2012 | Hamaji | |
| 8,162,109 | B2 | 4/2012 | Amano | |
| 8,172,044 | B2 | 5/2012 | Tokura | |
| 8,177,036 | B2 | 5/2012 | Stanley et al. | |
| 8,205,722 | B2 | 6/2012 | Suihkonen et al. | |
| 8,297,409 | B2 | 10/2012 | Hsu et al. | |
| 8,316,997 | B2 | 11/2012 | Mitsuda et al. | |
| 8,567,569 | B2 | 10/2013 | Suzuki et al. | |
| 8,651,242 | B2 | 2/2014 | Sarjanen et al. | |
| 8,662,255 | B2 | 3/2014 | Flynn et al. | |
| 8,662,256 | B2 | 3/2014 | Asano | |
| 8,678,142 | B2 | 3/2014 | Takeuchi | |
| 8,839,914 | B2 | 9/2014 | Iwata et al. | |
| 9,617,115 | B2 * | 4/2017 | Sarjanen | B66B 1/2458 |
| 2003/0221915 | A1 | 12/2003 | Brand et al. | |
| 2011/0120813 | A1 * | 5/2011 | Flynn | B66B 1/2458 187/384 |
| 2011/0155515 | A1 | 6/2011 | Suzuki et al. | |
| 2012/0152660 | A1 | 6/2012 | Fujihata et al. | |
| 2012/0152661 | A1 | 6/2012 | Suzuki et al. | |
| 2012/0175195 | A1 | 7/2012 | Koba | |
| 2012/0193173 | A1 | 8/2012 | Wu | |
| 2012/0228065 | A1 | 9/2012 | Tokura | |
| 2012/0228066 | A1 | 9/2012 | Mitsuda et al. | |
| 2012/0279808 | A1 | 11/2012 | Terry | |
| 2013/0001021 | A1 | 1/2013 | Stanley et al. | |
| 2013/0264150 | A1 | 10/2013 | Koba | |
| 2013/0284542 | A1 | 10/2013 | Eto | |
| 2014/0041968 | A1 | 2/2014 | Tokura | |
| 2014/0131142 | A1 | 5/2014 | Parkkinen | |
| 2014/0166409 | A1 | 6/2014 | Faruki et al. | |
| 2014/0291077 | A1 | 10/2014 | Suzuki | |

FOREIGN PATENT DOCUMENTS

| | | | |
|---|---|---|---|
| CN | 103221325 | A | 7/2013 |
| CN | 103303754 | A | 9/2013 |
| CN | 103889872 | A | 6/2014 |
| EP | 1747162 | B1 | 6/2013 |
| EP | 2292543 | B1 | 8/2014 |
| JP | 2010042917 | A | 2/2010 |
| WO | 2006022701 | A2 | 3/2006 |
| WO | 2014001082 | A1 | 1/2014 |
| WO | 2014118421 | A1 | 8/2014 |
| WO | 2014161598 | A1 | 10/2014 |

OTHER PUBLICATIONS

Chinese First Office Action and Search Report for application CN 201580061669.4, dated Nov. 8, 2018, 11 pages.

* cited by examiner

202

201

204

203

205

ELEVATOR CONTROL SYSTEM OVERLAY SYSTEM

FIELD OF THE INVENTION

The subject matter disclosed herein relates to control operations in an elevator system, and to a system and a method for overlaying destination dispatch functionality for existing elevator control systems.

DESCRIPTION OF RELATED ART

Typically, overlay control systems are used with existing elevator control systems to provide additional functionality to the existing elevator control system. For example, an overlay control system may add destination dispatch functionality to an existing elevator control system. Further, additional functionality, such as destination dispatch functionality may improve elevator system efficiency and decrease passenger wait times.

Overlay control systems are often used with a variety of varied and complex existing elevator control systems. These existing elevator control systems are often treated as a "black box" since the interior structure of the control systems cannot be seen nor changed. Therefore, overlay control systems may often rely on externally accessible controls and pre-defined behaviors of the existing control system to add additional functionality. These overlay systems often must work with the limitations of existing elevator control systems, often leading to difficulties or inabilities to perform certain desirable operation sequences, such as "reverse direction passenger requests". A system and method that can overlay destination dispatch functionality for existing elevator control systems is desired.

BRIEF SUMMARY

According to an embodiment, a method for providing destination dispatch service in an elevator control system includes recording a primary destination dispatch request from a primary passenger at a first floor position via a destination dispatch controller, identifying a terminal floor, providing a terminal floor call signal to the elevator control system via an overlay controller, moving an assigned elevator car in a travel direction of the terminal floor, recording at least one secondary destination dispatch request from a secondary passenger at a respective at least one secondary floor position via the destination dispatch controller, approximating a position of the assigned elevator car, determining an target floor position via the destination dispatch controller, entering an target floor call corresponding to the target floor position at a calculated time to stop the assigned elevator car at the target floor position, cancelling all pending calls via the elevator control system, and entering at least one recorded destination dispatch request to the elevator control system.

In addition to one or more of the features described above, or as an alternative, further embodiments could include determining the calculated time to minimize a distance between entering the target floor call and arrival of the assigned elevator car at the target floor position.

In addition to one or more of the features described above, or as an alternative, further embodiments could include approximating a velocity of the assigned elevator car and an acceleration of the assigned elevator car to determine the calculated time.

In addition to one or more of the features described above, or as an alternative, further embodiments could include that the target floor position is a highest floor position of the at least one recorded destination dispatch requests for the assigned elevator car.

In addition to one or more of the features described above, or as an alternative, further embodiments could include that the target floor position is a lowest floor position of the at least one recorded destination dispatch requests for the assigned elevator car.

In addition to one or more of the features described above, or as an alternative, further embodiments could include that approximating the position of the assigned elevator car uses a position feedback.

In addition to one or more of the features described above, or as an alternative, further embodiments could include that approximating the position of the assigned elevator car uses a mathematical approximation.

In addition to one or more of the features described above, or as an alternative, further embodiments could include that approximating the position of the assigned elevator car uses a simulation.

In addition to one or more of the features described above, or as an alternative, further embodiments could include identifying a reverse direction passenger request for the assigned elevator car.

According to an embodiment, a system for providing destination dispatch service in an elevator control system includes a passenger interface to record a primary destination dispatch request from a primary passenger at a first floor position and at least one secondary destination dispatch request from a secondary passenger at a respective at least one secondary floor position, an overlay controller to provide a terminal floor call signal to the elevator control system to move an assigned elevator car in a travel direction of the terminal floor, an approximation unit to approximate a position of the assigned elevator car, and a destination dispatch controller to determine a target floor position and to signal the overlay controller to enter a target floor call corresponding to the target floor position at a calculated time to stop the assigned elevator car at the target floor position, cancel all pending calls, and enter at least one recorded destination dispatch request to the elevator control system.

In addition to one or more of the features described above, or as an alternative, further embodiments could include that the approximation unit provides the calculated time to minimize a distance between entering the target floor call and arrival of the assigned elevator car at the target floor position.

In addition to one or more of the features described above, or as an alternative, further embodiments could include that the destination dispatch controller utilizes at least one of a jerk of the assigned elevator car ,an acceleration of the assigned elevator car, a deceleration of the assigned elevator car, and a velocity of the assigned elevator car to determine the calculated time.

In addition to one or more of the features described above, or as an alternative, further embodiments could include that the destination dispatch controller identifies a reverse direction passenger request for the assigned elevator car.

In addition to one or more of the features described above, or as an alternative, further embodiments could include that the target floor position is a highest floor position of the at least one recorded destination dispatch requests for the assigned elevator car.

In addition to one or more of the features described above, or as an alternative, further embodiments could include that the target floor position is a lowest floor position of the at least one recorded destination dispatch requests for the assigned elevator car.

Technical function of the embodiments described above includes providing a terminal floor call signal to the elevator control system via an overlay controller, approximating a position of the assigned elevator car, determining an target floor position via the destination dispatch controller, and entering an target floor call corresponding to the target floor position at a calculated time to stop the assigned elevator car at the target floor position.

Other aspects, features, and techniques of the invention will become more apparent from the following description taken in conjunction with the drawings.

BRIEF DESCRIPTION OF THE SEVERAL VIEWS OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION OF THE INVENTION

Figure 1:
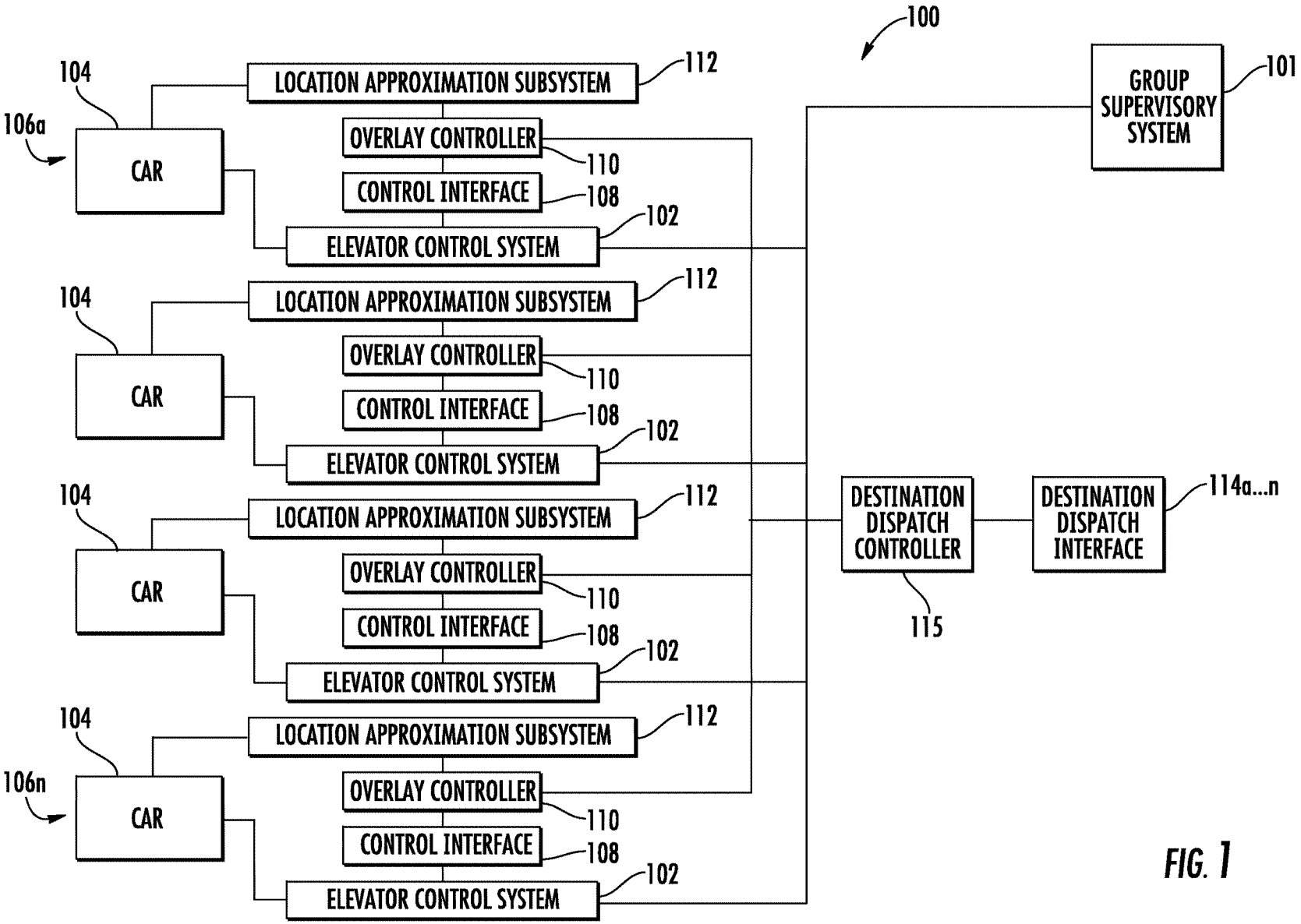
FIG. 1 illustrates a schematic view of an exemplary control system in accordance with an embodiment of the invention.

Referring now to the drawings, FIG. 1 illustrates a schematic view of an exemplary control system for use with a legacy elevator control system in accordance with an embodiment of the invention. In an embodiment, system 100 is an overlay elevator control system interfacing with an elevator control system 102 to provide destination dispatch functionality to elevator control system 102. System 100 includes an overlay controller 110 to interface with elevator control system 102, which controls elevator cars 104. Overlay controller 110 is associated with a position approximation subsystem 112, a destination dispatch controller 115, and destination dispatch interfaces 114*a*-114*n*. Elevator control system 102 controls the position and operation of cars 104 at positions 106*a*-106*n* and allows external input via control interface 108. In certain embodiments, a group supervisory control 101 can provide coordination and control over multiple cars 104 via elevator control systems 102. In certain embodiments, coordination and control of the cars 104 can be performed by a distributed group mechanism wherein each elevator control system 102 performs selected functions and communicate as required.

In an exemplary embodiment, elevator control system 102 is a legacy control system. Typically, legacy control systems are existing control systems that may provide basic elevator functionality. Legacy elevator control systems may vary in their design and/or operation, making the addition of additional functionality by altering the internal operation of elevator control system 102 undesirable, difficult, or impossible for certain applications. In certain embodiments, elevator control systems 102 are associated with each car 104. In certain embodiments, the elevator control systems 102 are centralized yet remain discrete for each car 104. In certain embodiments, the elevator control system 102 can control the movement of the car 104 from floor to floor, the position of the doors of the car 104, activation of control devices, monitor switches, etc.

Due to the varying and potentially complex nature of elevator control systems 102, overlay controllers 110 often treat elevator control system 102 as a "black box" and can only activate certain inputs to initiate the desired functionality without internal modification of elevator control system 102. In certain embodiments, the elevator control system 102 can provide outputs that enable the overlay controllers 110 to determine the current system status or other relevant operating information. Such an approach allows an overlay solution to be applied to a wide variety of systems 102 with minimal configuration or knowledge of the internal design of the existing system. Accordingly, in an exemplary embodiment, overlay controller 110 only utilizes existing function calls to elevator control system 102.

Cars 104 are each controlled by elevator control system 102. In an exemplary embodiment, the cars 104 are controlled in any suitable manner, but typically do not include destination dispatch support. Accordingly, in an exemplary embodiment, without the intervention of overlay controller 110, the group supervisory control 101 or any other suitable controller summons cars 104 at positions 106*a*-106*n* in response to passenger "hall calls" which specify a direction request to summon the car via control interface 108. Once a passenger has entered the car 104, the passenger then generally inputs the floor request or "car call" via another control interface 108. In certain embodiments, portions of the control interface 108 can be located within the car 104, while other portions may be in a centralized location.

In certain embodiments, destination dispatch functionality is desirable. Destination dispatch functionality may provide increased efficiency and reduced passenger wait times. In a destination dispatch system, a passenger enters their destination at a keypad/touchscreen located in the hallway before entering an elevator car. In an exemplary embodiment, the destination dispatch controller 115 can provide the control and logic for destination dispatch functionality within the system 100. In certain embodiments, the destination dispatch controller 115 can communicate with the overlay controller 110 using any suitable method and/or architecture. In certain embodiments, a passenger can enter their destination using a portable device, such as a smartphone or tablet, a security credential linked to a "home" floor, or any other suitable entry method. When the assigned elevator arrives, the passenger enters the assigned car and their destination car call is automatically registered. In an exemplary embodiment, the destination dispatch controller 115 can receive passenger input from the input devices described above. In certain embodiments, the destination dispatch controller 115 can require authentication via security credentials or other suitable methods. In certain embodiments, multiple destination dispatch controllers 115 can be utilized within the system 100.

In an exemplary embodiment, to provide destination dispatch functionality to an existing system, such as elevator control system 102, an overlay controller 110 is utilized. In an exemplary embodiment, each overlay controller 110 can be in communication with the destination dispatch controller 115. Overlaying is a modernization technique where monitoring and control devices are attached to an existing elevator control system either permanently or temporarily. In certain embodiments, an overlay system is used temporarily while the entire elevator control system is progressively modernized. In certain embodiments, the destination dispatch controller 115 can be utilized after overlay controllers 110 are removed after modernization.

In an exemplary embodiment, overlay controller 110 provides overlay control and functionality without any internal modifications to elevator control system 102. In certain embodiments, overlay controller 110 interfaces with elevator control system 102 with limitations regarding inputs to elevator control system 102. For example, an elevator control system 102 may only accept hall calls, car calls to a specific floor, and a cancellation of all calls, but not provide an accessible input to cancel any specific call. In an exemplary embodiment, elevator control system 102 will register and internally lock a car call, meaning the elevator car 104 must visit a position 106*n* before the entered car call can be removed. Advantageously, overlay controllers 110 provide an interface between the elevator control system 102 and the destination dispatch controller 115 to allow destination dispatch functionality.

In certain embodiments, a locked car call is undesirable, as optimal or desirable destination dispatch functionality is not achieved. For example, a locked car call may not allow desirable routing for a reverse direction passenger request. As shown in FIGS. 2A-2E, one example of a reverse direction passenger request is if a car 104 is called from a lower floor to a higher floor to service a passenger who wishes to go to a lower floor. In this example, if a second passenger on a higher floor wishes to also go to a lower floor, the elevator control system 102 cannot cancel the call if it is already entered (locked).

In an exemplary embodiment of an overlay destination dispatch system, a first passenger will select their desired destination via a destination dispatch interfaces 114*a*-114*n*. Destination dispatch interfaces 114*a*-114*n* can record passenger request information about passenger's source floor, source opening (front/rear), destination floor and destination opening. Further, in certain embodiments, destination dispatch interfaces 114*a*-114*n* can capture information regarding handicapped persons, VIP service, or if cart service is required. In certain embodiments, the destination dispatch controller 115 can receive passenger request information.

Information received from interfaces 114*a*-114*n* is provided to overlay controller 110 via the destination dispatch controller 115. In an exemplary embodiment, the destination dispatch controller 115 provides the passenger with information regarding which elevator car 104 to enter. In certain embodiments, the optimal car 104 is selected depending on usage, patterns, passenger wait time, in-car time, service time and other suitable criteria. In an exemplary embodiment, a car 104 is summoned by the destination dispatch controller 115 via the overlay controller 110 using external commands to the elevator control system 102 and control interface 108.

In an exemplary embodiment, the overlay controller 110 delays providing a car call signal (a call to a specific floor) to allow additional passengers to be serviced in an optimal manner. Alternatively, in an exemplary embodiment, overlay controller 110 provides a car call signal to the elevator control system 102 at a terminal floor. In an exemplary embodiment, a terminal floor is the highest floor of an elevator service range or the lowest floor of an elevator service range, depending on the direction of service. In certain embodiments, the terminal floor is the last serviceable floor of the elevator range. For example, if the last serviceable floor of a given car 104 is the $8^{th}$ floor, while the terminal floor is the $10^{th}$ floor, the $8^{th}$ floor may effectively be considered either the terminal floor or the last serviceable floor for the purposes of overlay controller 110. Advantageously, by selecting the terminal floor, a car 104 is not required to stop at passenger requested floors in the order dictated by the elevator control system 102. Instead, destination dispatch controller 115 may determine it is advantageous to stop at passenger requested floors in an alternative order than directed by elevator control system 102.

In order to stop at a passenger requested floor as determined optimal by the destination dispatch controller 115 a position approximation subsystem 112 may be utilized. In certain embodiments, position approximation subsystem 112 is a separate component that interfaces with overlay controller 110. In other embodiments, position approximation subsystem 112 is integrated with overlay controller 110. In certain embodiments, the position approximation subsystem 112 can use position data gathered from sensors that are part of the existing elevator control system 102. In other embodiments, sensors are added for use by the destination dispatch controller 115, overlay controller 110 and position approximation subsystem 112. In certain embodiments, installed sensors can be reused after the elevator control system 102 is modernized.

In an exemplary embodiment, position approximation subsystem 112 signals to the destination dispatch controller 115 to input a car call at a calculated time or distance before arriving at the corresponding floor. Advantageously, while car 104 is traveling toward the terminal floor, the car 104 is not committed to stop until the calculated time or distance before arriving at the corresponding floor. In certain embodiments, position approximation subsystem 112 uses position information, velocity information, acceleration information, deceleration information, jerk information, mathematical formulas, simulations, and/or sensor data to determine the motion profile and behavior of car 104. In an exemplary embodiment, position approximation subsystem 112 can utilize existing elevator mechanisms such as call lights and door status provided by elevator control system 102. In certain embodiments, the motion profile parameters, such as the jerk, acceleration, and deceleration rates can vary based on operating conditions. In certain embodiments, motion profile parameters can be obtained by reading output parameters from the elevator control system 102, or by measurements performed by the destination dispatch controller 115. In other embodiments, a technician can utilize experimental observation of the elevator cars 104 to determine motion profile parameters. In an exemplary embodiment, position approximation subsystem 112 determines when car 104 will reach a stop control point for a respective floor. A stop control point is the latest point when a call to a floor can be entered or registered and car 104 will stop on the respective floor. In certain embodiments, the stop control point is the ideal latest point at which stopping can be initiated while maintaining the desired motion profile parameters, such as jerk and deceleration rates. Therefore, in certain embodiments, the overlay controller 110 and the destination dispatch controller 115 can utilize motion profile parameters to determine stop control points.

In certain embodiments, the overlay controller 110 may experience a system reaction time when interfacing with the elevator control system 102. For example, the system reaction time may include the time for the overlay controller 110 to output the car call to the control interface 108 for the desired target floor, then for the car call to be processed by the elevator control system 102 to initiate the slowdown and stop of the elevator car 104 at the target floor. In certain embodiments, to compensate for the system reaction time, the stop control point must be determined earlier. In an exemplary embodiment, position approximation subsystem 112 minimizes the time before placing a call via overlay controller 110 to elevator control system 102 to minimize locked call time.

Advantageously, by delaying the input of a car call at a passenger requested floor, a second (or additional) passenger at a higher or lower floor may be served if the destination dispatch controller 115 determines serving the passenger is an optimal routing. In an exemplary embodiment, additional passengers at higher (or lower) floors are capable of being served by car 104 until the delayed car call is entered. In certain embodiments, the destination dispatch controller 115 will determine the optimal floor to first stop is the floor closest to the terminal floor. After the initial stop, car 104 will return in the opposite direction to serve remaining passengers. Accordingly, the destination dispatch controller 115 can determine the target floor (closest to the terminal floor) for a greater range of scenarios.

In an exemplary embodiment, after the floor closest to the terminal floor is reached, an overlay control 110 issues a call cancel command externally to the elevator control system 102 via control interface 108.

In an exemplary embodiment, after the call cancel command is issued, the overlay controller 110 will issue car calls in a travel direction opposite the terminal floor. These car calls may be recorded passenger requests for pick up or recorded destination requests of existing passengers. Advantageously, the destination dispatch controller 115 may optimally determine the stops and routing accordingly. In an alternative embodiment, overlay controller 110 can designate a terminal floor in the opposite direction and the destination dispatch controller 115 can perform a position approximation via position approximation subsystem 112 to calculate delayed car calls.

Figure 2B:
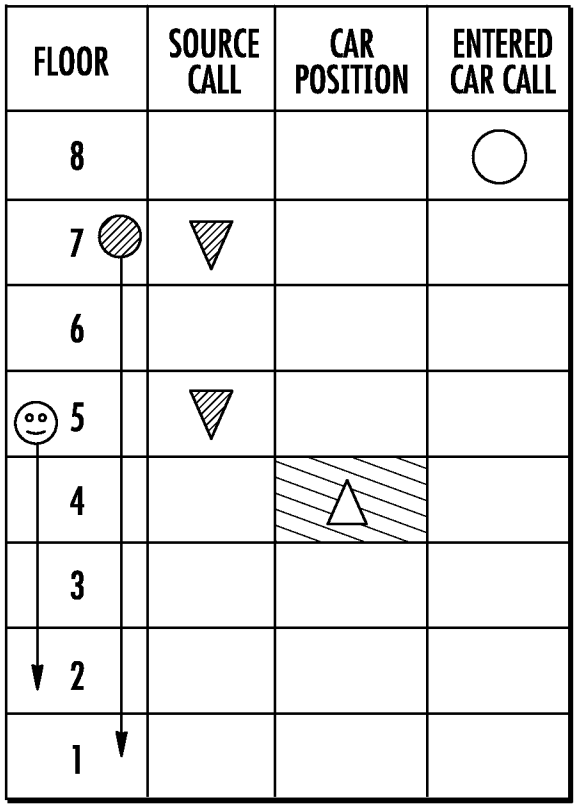
FIGS. 2A-2E illustrate an example of serving a reverse direction passenger request in accordance with an embodiment of the invention.
Figure 2A:
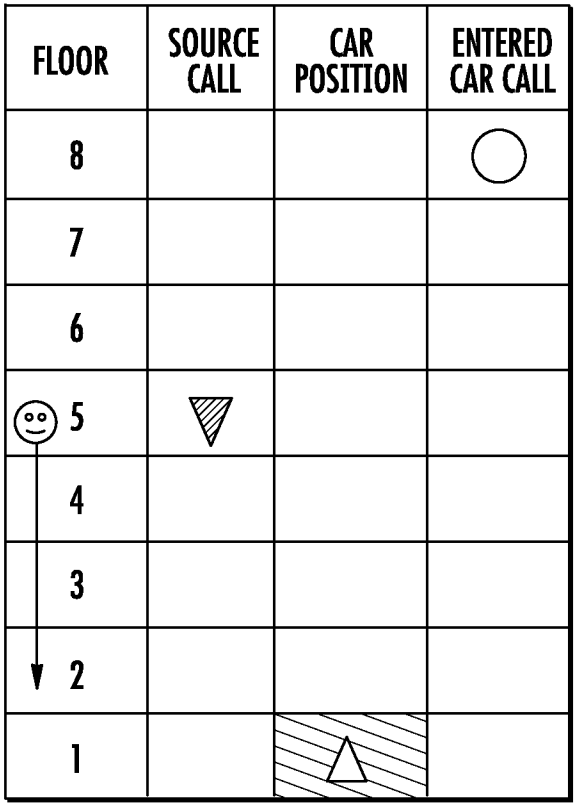

FIGS. 2A-2E show an exemplary embodiment of the system described in FIG. 1. In FIG. 2A, 201 shows an initial passenger at floor 5 entering a destination request to floor 2 via a destination dispatch interface 114*a*-114*n*. The overlay controller 110 enters a car call via control interface 108 at terminal floor 8 and the car begins travelling upward.

In FIG. 2B, 202 shows a new passenger request at floor 7 entered via destination dispatch interface 114*a*-114*n*. Advantageously, since a car call to pick up the first passenger was not entered to the elevator control system 102, the car 104 may continue upwards to floor 7 to service the new passenger request first.

Figure 2D:
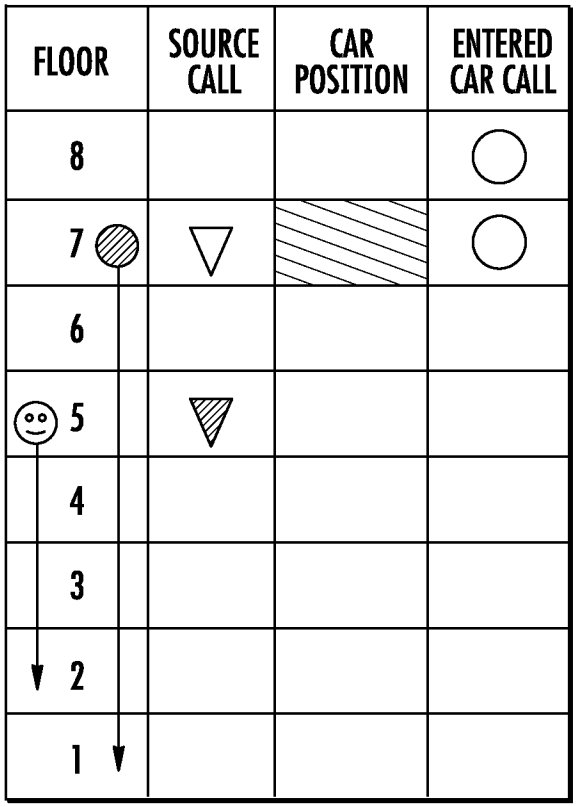
Figure 2C:
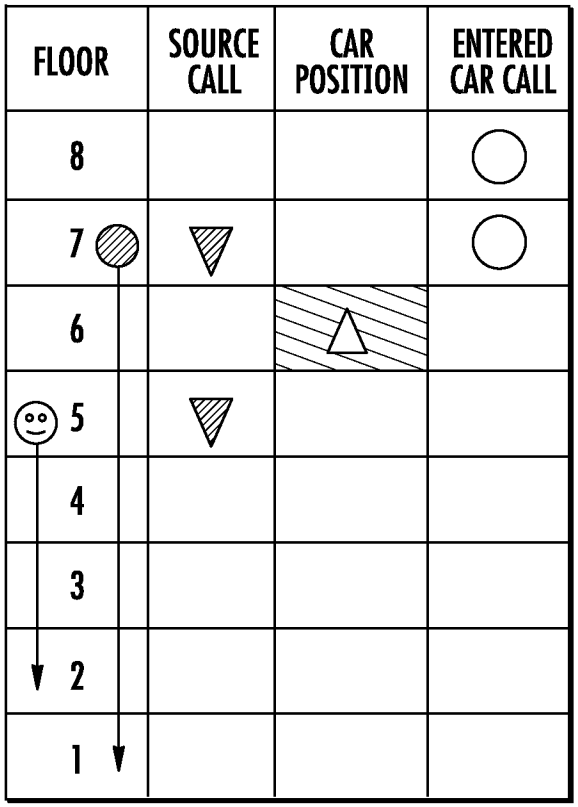

In FIG. 2C, 203 shows that as car 104 approaches floor 7, position approximation subsystem 112 and overlay controller 110 have entered a car call to stop car 104 at floor 7.

In FIG. 2D, 204 shows the car 104 stops at floor 7. As the car 104 begins to open its doors the overlay controller 110 sends a call cancel signal to elevator control system 102. Accordingly, all calls on the elevator control system 102 are cancelled.

Figure 2E:
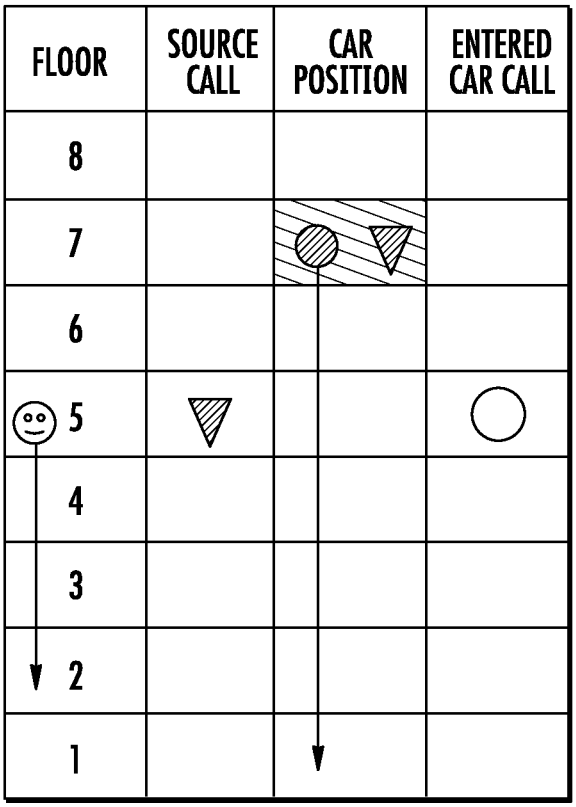

In FIG. 2E, 205 shows that passenger at floor 7 enters the car 104. Overlay controller 110 now enters a car call for the previous recorded passenger call at floor 5 to service the initial call in an optimized manner.

Figure 3:
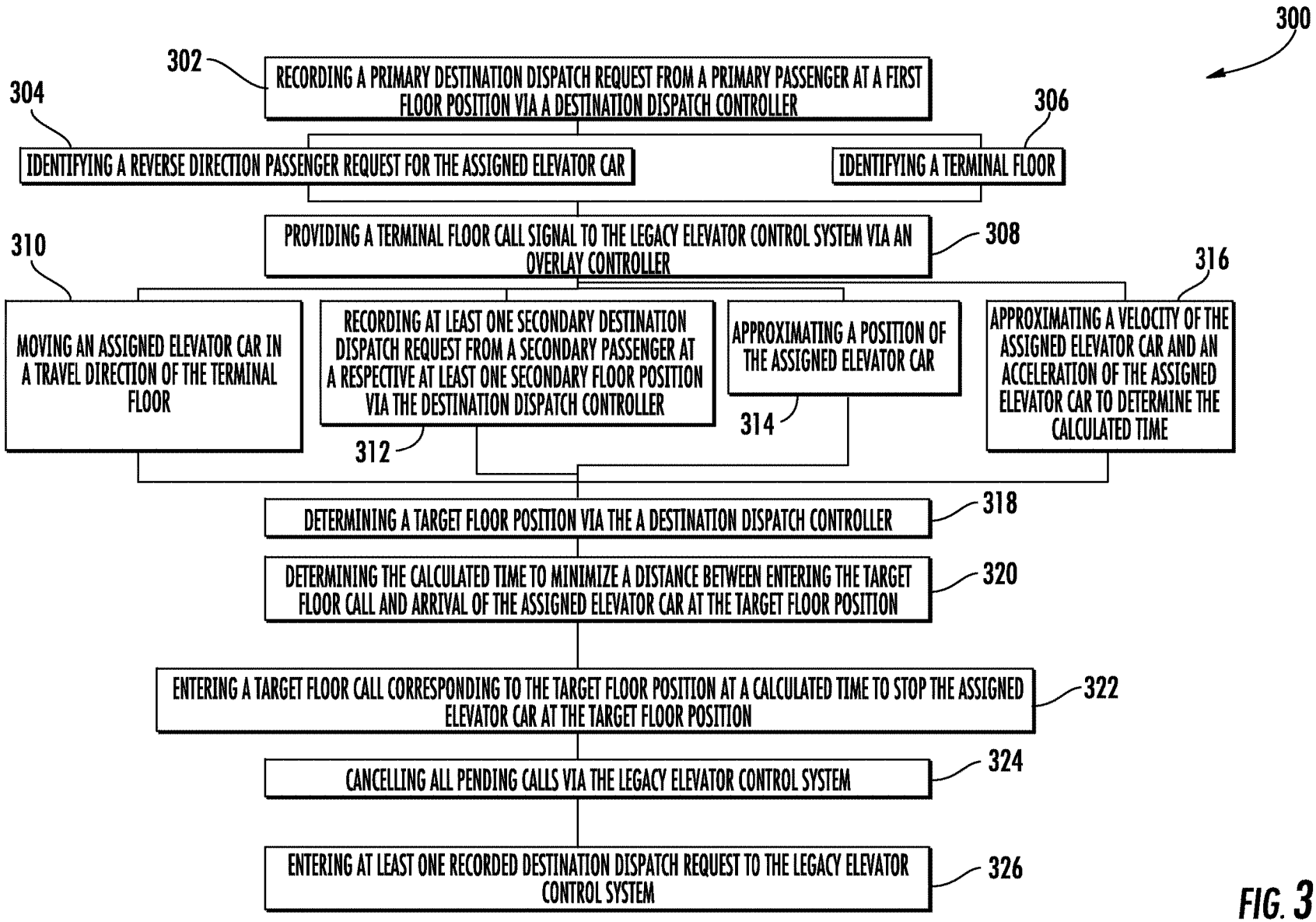
FIG. 3 is a flow diagram of a method of serving a reverse direction passenger request in accordance with an embodiment of the invention.

FIG. 3 illustrates a method for destination dispatch operations for legacy elevator control systems. In operation 302 a primary destination dispatch request from a primary passenger at a first floor position is recorded via the destination dispatch controller and destination dispatch interface.

In operation 304, the destination dispatch controller may query the position of a car and the destination request's source to determine if the request is a reverse direction passenger request. In operation 306, in certain embodiments, the destination dispatch controller may identify a terminal floor. In other embodiments, the terminal floor is stored in memory or determined in another suitable manner.

In operation 308, after a primary destination dispatch is received in operation 302, a floor call to terminal floor is provided to the elevator control system via the overlay controller. In an exemplary embodiment, a car call corresponding to the first passenger's position is not entered at this time.

In operation 310 the elevator may begin to move in an upward or downward direction toward the selected terminal floor. In an exemplary embodiment, the "reverse direction passenger request" is a request with a passenger located above the car position that wishes to go down. In an alternative embodiment, the "reverse direction passenger request" is a request with a passenger located below the car position that wishes to go up.

In operation 312 at least one secondary destination dispatch call may be received. These calls may be above or below the initial call. In operation 314 the destination dispatch controller and position approximating subsystem approximate the position of the car. In operation 316, in certain embodiments, velocity information, acceleration information, deceleration information, jerk information, of the car are used to determine the time to enter a floor call for a given stop control point. In other embodiments, sensors, simulations, and other inputs from the existing elevator control system are used.

In operation 318 the overlay controller continuously determines the target floor position to stop first. In an exemplary embodiment, if a reverse direction passenger request is identified, the floor closest to the terminal floor is typically the target floor to stop first in the direction of travel.

In operation 320 the information from operations 314 and 316 is used to determine the calculated call entry time for a determined target floor. In certain embodiments, a distance can be calculated as the calculated call entry distance for the determined target floor. In an exemplary embodiment, the call is entered at the latest time possible before a stop control point for a respective floor. Advantageously, delaying the call allows for additional passenger requests to the recorded and served. In operation 322 the floor call is entered at the calculated time or distance to the target floor.

In operation 324 the call cancel functionality of legacy elevator control system is triggered by overlay controller to cancel all pending calls.

In operation 326 the recorded destinations stored in overlay controller are input. These recorded destinations may service passengers within the elevator car or to pick up passengers as the elevator travels away from the terminal floor.

In certain embodiments, the described method may repeat. In certain embodiments, the overlay controller can identify an alternative terminal floor and perform the same delayed call functionality for desired routing and request management as described. In an exemplary embodiment, the system and described method can handle calls in the direction of travel without needed to enter a terminal call (in path calls). In an exemplary embodiment, in path calls do not require the use of a terminal call.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for providing destination dispatch service in an elevator control system, comprising:

recording a primary destination dispatch request from a primary passenger at a first floor position via a destination dispatch controller;

identifying a terminal floor;

providing a terminal floor call signal to the elevator control system via an overlay controller;

moving an assigned elevator car in a travel direction of the terminal floor; recording at least one secondary destination dispatch request from a secondary passenger at a respective at least one secondary floor position via the destination dispatch controller;

approximating a position of the assigned elevator car;

determining an target floor position via the destination dispatch controller;

entering an target floor call corresponding to the target floor position at a calculated time to stop the assigned elevator car at the target floor position;

cancelling all pending calls via the elevator control system; and entering at least one recorded destination dispatch request to the elevator control system.

2. The method of claim 1, further comprising determining the calculated time to minimize a distance between entering the target floor call and arrival of the assigned elevator car at the target floor position.

3. The method of claim 1, further comprising approximating a velocity of the assigned elevator car and an acceleration of the assigned elevator car to determine the calculated time.

4. The method of claim 1, wherein the target floor position is a highest floor position of the at least one recorded secondary destination dispatch requests for the assigned elevator car.

5. The method of claim 1 wherein the target floor position is a lowest floor position of the at least one recorded secondary destination dispatch requests for the assigned elevator car.

6. The method of claim 1, wherein approximating the position of the assigned elevator car uses a position feedback.

7. The method of claim 1, wherein approximating the position of the assigned elevator car uses a mathematical approximation.

8. The method of claim 1, wherein approximating the position of the assigned elevator car uses a simulation.

9. The method of claim 1, further comprising identifying a reverse direction passenger request for the assigned elevator car.

10. A system for providing destination dispatch service in an elevator control system, comprising:

a passenger interface to record a primary destination dispatch request from a primary passenger at a first floor position and at least one secondary destination dispatch request from a secondary passenger at a respective at least one secondary floor position;

an overlay controller to provide a terminal floor call signal to the elevator control system to move an assigned elevator car in a travel direction of a terminal floor;

an approximation unit to approximate a position of the assigned elevator car; and a destination dispatch controller to determine a target floor position and to signal the overlay controller to enter a target floor call corresponding to the target floor position at a calculated time to stop the assigned elevator car at the target floor position, cancel all pending calls, and enter at least one recorded destination dispatch request to the elevator control system.

11. The system of claim 10, wherein the approximation unit provides the calculated time to minimize a distance between entering the target floor call and arrival of the assigned elevator car at the target floor position.

12. The system of claim 10, wherein the destination dispatch controller utilizes at least one of a jerk of the assigned elevator car, an acceleration of the assigned elevator car, a deceleration of the assigned elevator car, and a velocity of the assigned elevator car to determine the calculated time.

13. The system of claim 10, wherein the destination dispatch controller identifies a reverse direction passenger request for the assigned elevator car.

14. The system of claim 10, wherein the target floor position is a highest floor position of the at least one recorded secondary destination dispatch requests for the assigned elevator car.

15. The system of claim 10, wherein the target floor position is a lowest floor position of the at least one recorded secondary destination dispatch requests for the assigned elevator car.

* * * * *